US009771187B2

(12) United States Patent
FitzSimons

(10) Patent No.: US 9,771,187 B2
(45) Date of Patent: Sep. 26, 2017

(54) LID AND METHOD OF USING A LID

(71) Applicant: Corytus, LLC, Oklahoma City, OK (US)

(72) Inventor: Colin FitzSimons, Oklahoma City, OK (US)

(73) Assignee: CORYTUS, LLC, Oklahoma City, OK (US)

( * ) Notice: Subject to any disclaimer, the term of this patent is extended or adjusted under 35 U.S.C. 154(b) by 0 days.

(21) Appl. No.: 15/102,932

(22) PCT Filed: Jul. 24, 2015

(86) PCT No.: PCT/US2015/041923
§ 371 (c)(1),
(2) Date: Jun. 9, 2016

(87) PCT Pub. No.: WO2016/014909
PCT Pub. Date: Jan. 28, 2016

(65) Prior Publication Data
US 2016/0311582 A1 Oct. 27, 2016

Related U.S. Application Data

(60) Provisional application No. 62/029,074, filed on Jul. 25, 2014.

(51) Int. Cl.
*B65D 43/02* (2006.01)
*B65D 45/20* (2006.01)
(Continued)

(52) U.S. Cl.
CPC ..... *B65D 43/0212* (2013.01); *B65D 41/18* (2013.01); *B65D 41/22* (2013.01);
(Continued)

(58) Field of Classification Search
CPC ..... B65D 2543/00046; B65D 41/18; B65D 45/20; B65D 2543/00842; B65D 41/22; B65D 41/225; B65D 43/0212
(Continued)

(56) References Cited

U.S. PATENT DOCUMENTS 1,904,091 A 4/1933 Shoop
2,215,392 A * 9/1940 Freeman ..... B65D 41/225 215/307

(Continued)

FOREIGN PATENT DOCUMENTS

GB 370027 A 3/1932
GB 2417952 A 3/2006

(Continued)

OTHER PUBLICATIONS

"Silicone Stretch Storage Lids (6 Piece Set)" Simplygoodstuff.corn [online]. Jul. 4, 2013. Retrieved on Sep. 28, 2015. Retrieved from the Internet. <http://web.archive.org/web/20130704082540/http://www.simplygoodstuff.com/silicone_stretch-lids.html>.

(Continued)

*Primary Examiner* — Jeffrey Allen
*Assistant Examiner* — Jennifer Castriotta
(74) *Attorney, Agent, or Firm* — McAfee & Taft, A Professional Corporation

(57) ABSTRACT

The lid includes a body having a top surface and a bottom surface, the top surface includes a groove therein separating an inner portion and an outer portion. The lid also includes a flexible skirt integrally joined to and carried by the outer periphery edge of the body. The groove defines a flexible zone which permits the flexible skirt to flip between a first position and a second position. The method of using the lid includes the step of positioning the lid with the flexible skirt in a second position above an open end of a container. The (Continued)

method further includes the step of securing the lid and the container together by moving the flexible skirt from the second position to a first position to cause engagement of the flexible skirt with the container thereby forming a removable attachment and a substantial seal between the lid and the container.

28 Claims, 12 Drawing Sheets

(51) Int. Cl.
*B65D 41/18* (2006.01)
*B65D 47/06* (2006.01)
*B65D 41/22* (2006.01)
*B65D 51/24* (2006.01)

(52) U.S. Cl.
CPC ..... *B65D 41/225* (2013.01); *B65D 45/20* (2013.01); *B65D 47/06* (2013.01); *B65D 51/24* (2013.01); *B65D 2543/00046* (2013.01); *B65D 2543/00092* (2013.01); *B65D 2543/00296* (2013.01); *B65D 2543/00537* (2013.01); *B65D 2543/00685* (2013.01); *B65D 2543/00731* (2013.01); *B65D 2543/00796* (2013.01); *B65D 2543/00842* (2013.01)

(58) Field of Classification Search
USPC ..... 220/305, 780; 215/317, 321, 272
See application file for complete search history.

(56) References Cited

U.S. PATENT DOCUMENTS 2,218,308 A * 10/1940 Comer ..... B65D 47/20 215/317
2,486,364 A * 10/1949 Simmons ..... B65D 41/185 215/11.1
2,639,058 A * 5/1953 Lobl ..... B65D 41/225 220/319
3,628,542 A 12/1971 Drew
3,831,797 A * 8/1974 Stevens, Jr. ..... B65D 50/066 215/216
4,376,493 A * 3/1983 Gall ..... B65D 43/0218 215/272
4,387,820 A * 6/1983 Ignell ..... B65D 41/225 215/320
4,465,205 A * 8/1984 Sutch ..... B65D 43/0295 220/270
4,632,271 A * 12/1986 Taylor ..... B65D 41/18 220/258.2
4,747,511 A 5/1988 Dutt et al.
4,756,440 A 7/1988 Gartner
4,768,668 A * 9/1988 Van Den Brink .. B29C 45/4407 215/305
4,911,323 A * 3/1990 Arfert ..... B65D 41/525 220/254.7
4,961,510 A 10/1990 Dvoracek
5,749,491 A 5/1998 Wylder et al.
6,047,852 A 4/2000 Evans et al.
6,164,488 A 12/2000 Solland et al.
6,276,560 B1 8/2001 Belcastro
6,604,645 B1 8/2003 Vaupotic
6,883,677 B2 4/2005 Goeking et al.
7,185,784 B2 3/2007 Connors, Jr. et al.
8,087,539 B2 1/2012 Auer et al.
8,091,730 B2 1/2012 Keefe et al.
8,286,827 B2 10/2012 Yacktman
8,333,299 B2 12/2012 Kemper et al.
8,678,212 B2 3/2014 Kim
2003/0019876 A1 1/2003 Burke et al.
2005/0067417 A1 3/2005 Sanders et al.
2005/0173434 A1* 8/2005 O'Neal ..... B65D 43/0212 220/212
2007/0023434 A1* 2/2007 Kim ..... B65D 41/22 220/315
2008/0061069 A1 3/2008 Edelstein et al.
2008/0237247 A1 10/2008 Mucci et al.
2009/0272769 A1 11/2009 Contreras et al.
2010/0012670 A1* 1/2010 Massey ..... B65D 47/06 220/717
2012/0061404 A1 3/2012 Roth et al.
2012/0067910 A1 3/2012 Chun
2013/0233854 A1 9/2013 Smyers et al.
2013/0284753 A1 10/2013 Kellmann

FOREIGN PATENT DOCUMENTS

WO 2014040039 A1 3/2014
WO 2014160642 A1 10/2014

OTHER PUBLICATIONS

International Search Report, PCT/US2015/041923, dated Jan. 19, 2016, Colin FitzSimons.
International Search Report, PCT/US14/31582, dated Aug. 21, 2014, Sativa Turner.

* cited by examiner

LID AND METHOD OF USING A LID

CROSS REFERENCE TO RELATED APPLICATIONS

This application is a national phase entry of PCT Application No. PCT/US2015/041923 entitled A Lid and Method of Using a Lid filed Jul. 24, 2015, which claims priority from U.S. Provisional Patent Application Ser. No. 62/029,074 filed Jul. 25, 2014, the entirety of the disclosures of which are each incorporated herein by reference.

BACKGROUND

During an athletic event, for example, a running race, runners are often provided a cup of liquid, usually between about 6.0 to about 9.0 ounces of water or a sports drink, in either a paper or plastic based cup at an aid station. The race participants tend to find the acts of running and drinking the liquid difficult and not as effective of simply stopping to drink the liquid due spilling, disruption of the participant's pace and/or breathing, or causing an upset stomach due to the swallowing of excess air. In longer distance activities these issues can contribute to diminished performance. The lack of ability to drink effectively while running creates a significant mess around aid stations that affect other runners due to slippery conditions and discarded cups. Typically, the activity participants do not wish to carry a cup of sloshing liquid for an extended distance, participants try to drink and discard the cups all within approximately thirty (30) yards (27.43 meters) of an aid station. While trash bins are normally located near the aid station, a vast majority of cups are simply thrown on the ground, thus increasing (i) safety concerns for other runners slipping and falling on the discarded cups; and (ii) the need for additional manpower or volunteers to clean up the discarded cups from the ground.

In other situations, for example, on an airplane, passengers are provided a cup of liquid in an open container. Many passengers also use his/her portable electronic devices during the flight. When the airplane experiences turbulence, or the cup is accidently knocked over, the liquid within the cup may spill onto the vulnerable electronic devices and thereby ruin the electronic devices.

In other situations, young children may be too young or lack the coordination skills to drink from an open container without spilling. Special cups with matching lids are manufactured and sold to address the spilling of cups by children. When the matched lid is misplaced, the cup becomes useless for its spill-proof convenience, and is usually discarded for lack of the matched lid.

Like the mismatched children's cup lid, a similar problem exists with food storage containers. Often the matching lid of a storage container goes missing and thus, the container can no longer be enclosed with a lid. Household bowls and cups do not typically come with matching lids. If a person is desirous of covering the open end of the container, he/she must use a make-shift cover with plastic wrap or aluminum foil. The make-shift cover has limited ability to be reused and is usually discarded into the trash after a few uses. The discarded material contributes to the growing waste in landfills and waters throughout the world. Therefore, it is desirable to have a lid that does not require a matched container that can be used with varying sized cups or containers.

In view of the above identified problems, a need exists for a versatile, portable, reusable, and universal lid to cover a container of varying sizes and shapes, and thereby minimize spilling of the container contents. Further, a need exists for a method providing removable attachment of the universal lid to containers.

SUMMARY

The apparatus and method described herein provide removable attachment of a lid with a container. The apparatus described herein includes a body having a top surface and a bottom surface, the top surface includes an inner portion and an outer portion, the inner portion and outer portion are separated by a groove, the outer portion defines an outer periphery edge of the body. The lid also includes a flexible skirt integrally joined to and carried by the outer periphery edge of the body and the flexible skirt extends therefrom. The groove defines a flexible zone which permits the flexible skirt to flip between a first position and a second position. The movement of the flexible skirt from the first position to the second positions narrows the width of the groove. When the flexible skirt is in the first position, the flexible skirt projects downward and away from the top surface and an edge of the flexible skirt distal from the body defines a perimeter less than the perimeter defined by the outer periphery edge of the body. The second position is inverted from the first position. The flexible skirt provides for removable coupling of the lid with a container. The lid may also include a fastening member attached to the bottom surface of the body. In lieu of, or in addition to the fastening member, the lid may also include a spout extending outward from the top surface. The spout has an opening in the top end thereof. The spout defines a conduit to permit fluid communication through the body of the lid.

A method of removably securing a lid to a container is disclosed. The container includes an open end, and the lid includes a body having a top surface including an inner portion and an outer portion, the outer portion defining an outer periphery edge of the body. The lid also includes a bottom surface, and a groove separating the top surface inner portion from the top surface outer portion, and a flexible skirt integrally joined to the outer periphery edge of the body and extending therefrom. The groove in the top surface of the lid defines a flexible zone which permits the flexible skirt to flip between a first position and a second position. The method comprises positioning the lid with the flexible skirt in the second position over the open end of the container. The flexible skirt extends upward from the top surface when the flexible skirt is in the second position. The method further includes securing the lid and the container together by moving the flexible skirt from the second position to the first position by causing the flexible skirt to flip about the flexible zone to cause engagement of the flexible skirt with an outer surface of the container thereby forming a removable attachment and a substantial seal between the lid and the container. The flexible skirt extends downward from the top surface of the body when the flexible skirt is in the first position.

BRIEF DESCRIPTION OF THE DRAWINGS

It should be appreciated that the appended drawings are illustrative of several typical embodiments and are not intended to be considered limiting of the scope of the presently disclosed devices, structures, and methods. Further, any dimensions depicted in the drawings are for illustrative purposes only and are not to be construed as limiting the presently disclosed devices, structures, and methods. Further, the figures may not necessarily be depicted to scale and certain features and certain views of the figures may be shown as exaggerated in scale or in schematic in the interest of clarity and/or conciseness.

FIG. 2I is an enlarged view of the cross-section of FIG. 2H.

FIG. 2J is a side view of the lid of FIG. 2A in a second position.

DETAILED DESCRIPTION

Figure 1A:
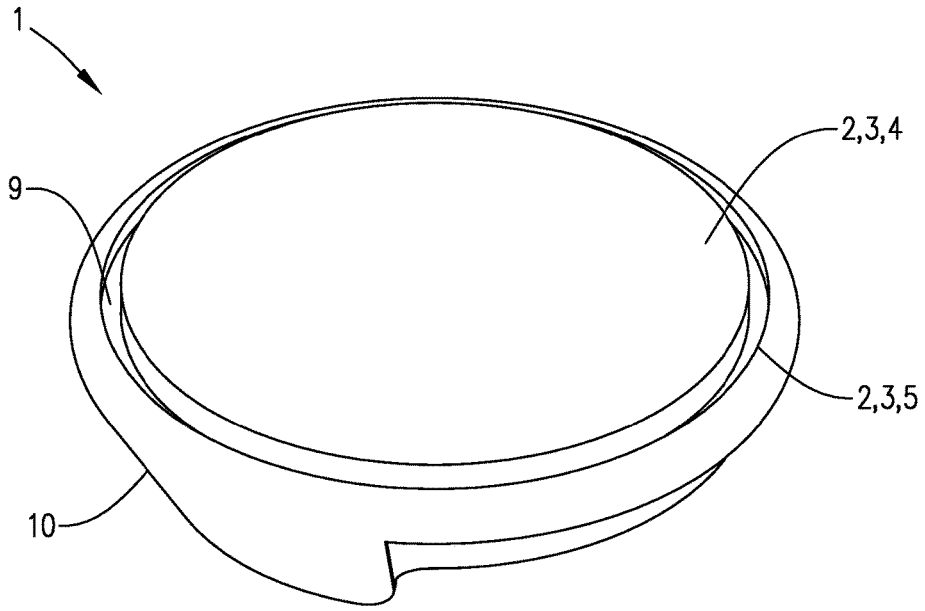
FIG. 1A is an isometric view of one embodiment of the lid in a first position.
Figure 1B:
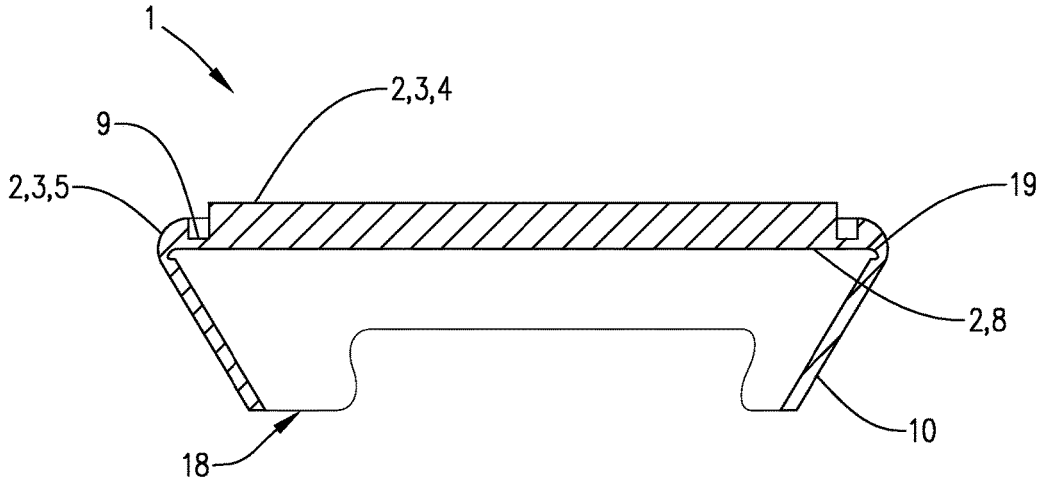
FIGS. 1B and 1C are cross-sectional views of the lid of FIG. 1A.
Figure 1C:
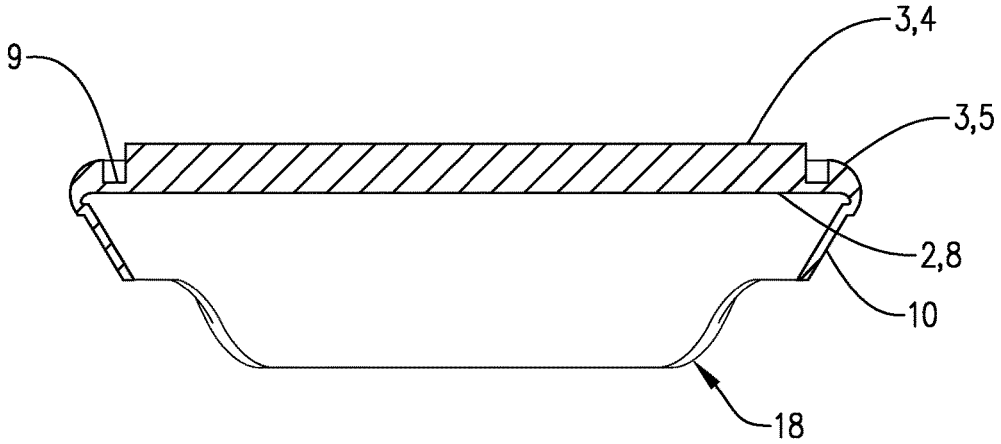

Referring to the FIGS., lid 1 includes a body 2 having a top surface 3 including an inner portion 4 and an outer portion 5 defining an outer periphery edge of the body. The outer periphery edge of the body is a rounded surface. Body 2 also include a bottom surface 8 and a groove 9 separating the top surface inner portion 4 from the top surface outer portion 5 as shown in FIGS. 1A, 1B, 2A-2C, and 3A-3C. Top surface 3 and bottom surface 8 are generally planar surfaces. Lid 1 also includes flexible skirt 10, which will be discussed in further detail below, is integrally joined to the outer periphery edge of body 2 and extending therefrom.

Figure 1D:
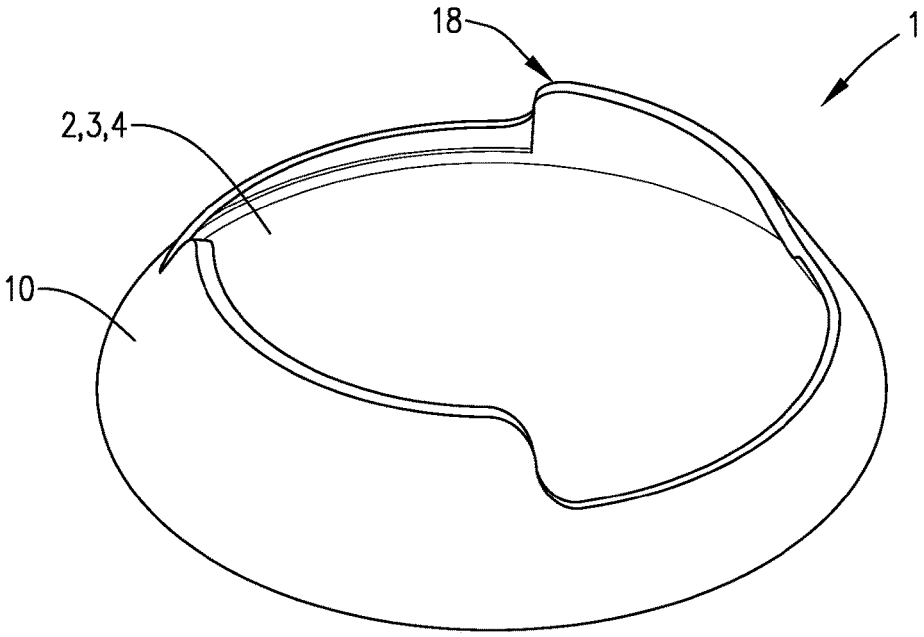
FIG. 1D is an isometric view of the lid in a second position.
Figure 1E:
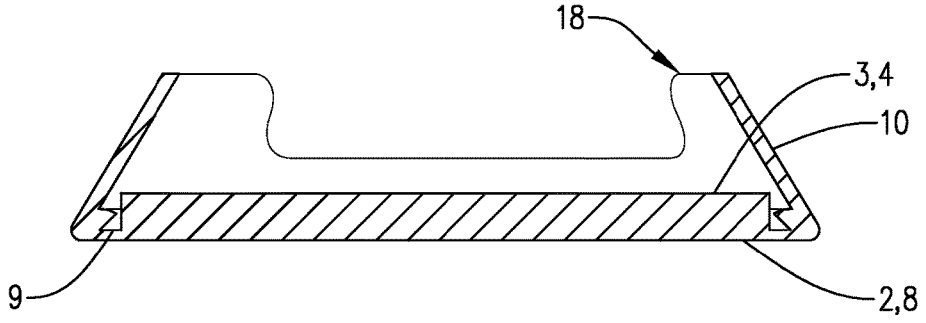
FIG. 1E is a cross-sectional view of the lid in a second position.

With reference to groove 9 and the FIGS., groove 9 defines a flexible zone which permits flexible skirt 10 to flip between a first position (depicted in FIGS. 1A, 2A, 3A, and 4E) and a second position (depicted in FIGS. 1D, 2J, 3D, and 4A). Movement of flexible skirt 10 from the first position to the second positions narrows the width of groove 9 as shown in FIGS. 1D and 1E. Groove 9 allows flexible skirt 10 to transition between first position and second position more easily and simultaneously allows for body 2 to remain flat while flexible skirt 10 is in the second position. As shown in the FIGS., first position and second positions are inverted from each other.

Figure 2A:
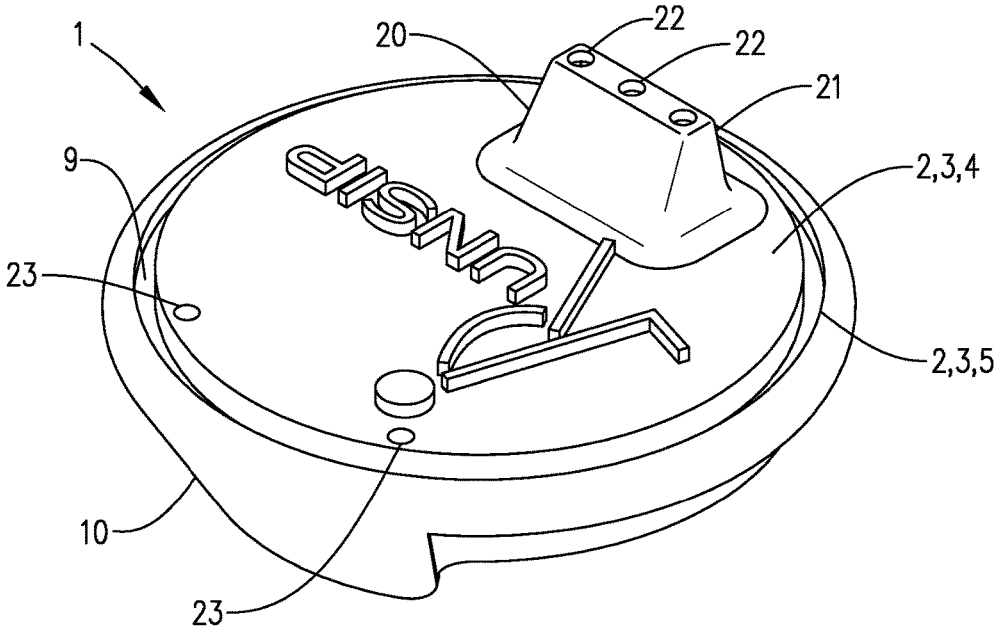
FIG. 2A depicts another example embodiment of the lid.
Figure 2B:
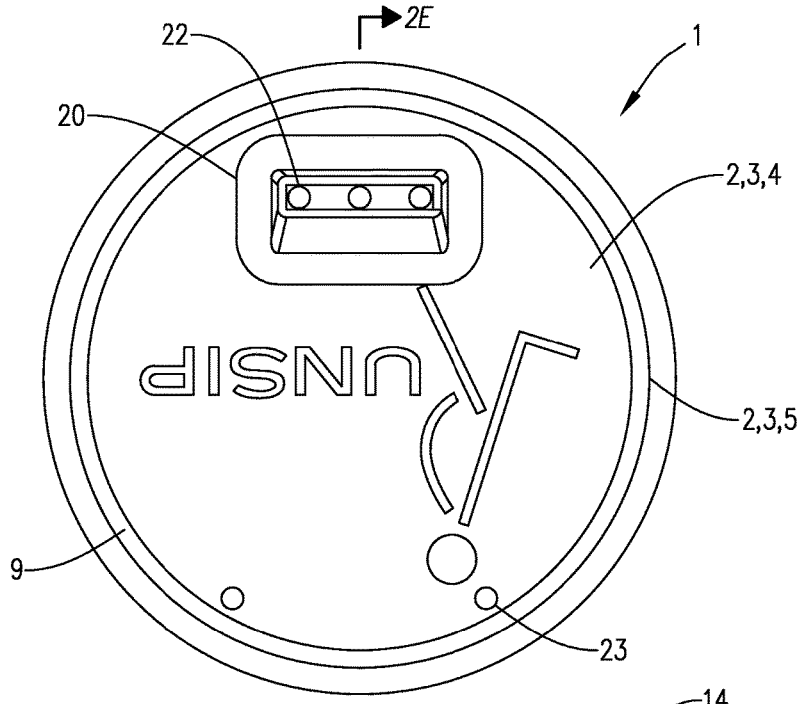
FIG. 2B is a top view of the lid of FIG. 2A
Figure 2C:
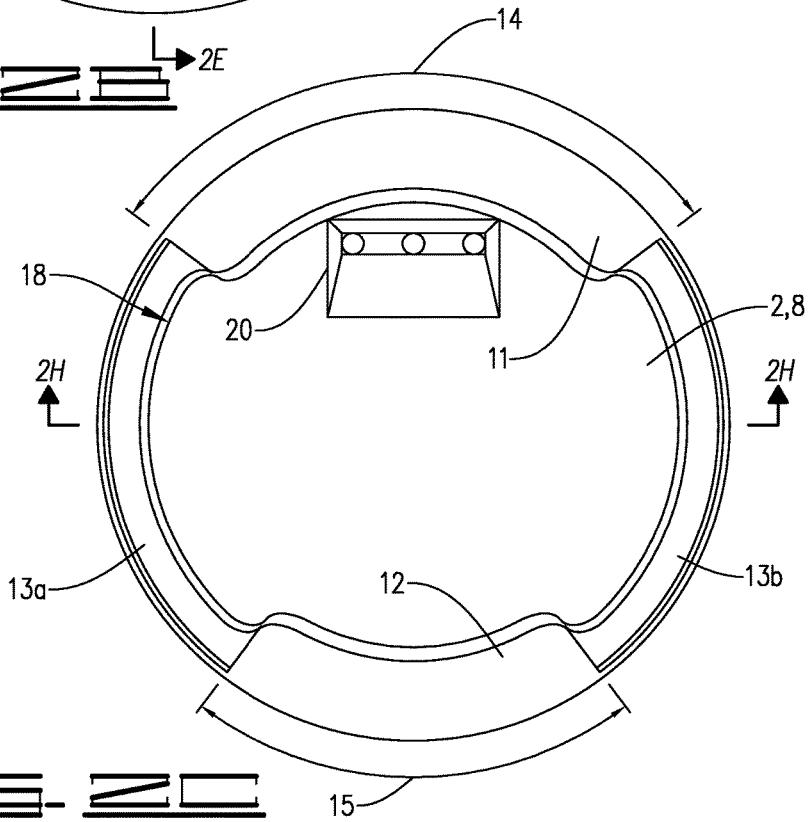
FIG. 2C is a bottom view of the lid of FIG. 2A.
Figure 2D:
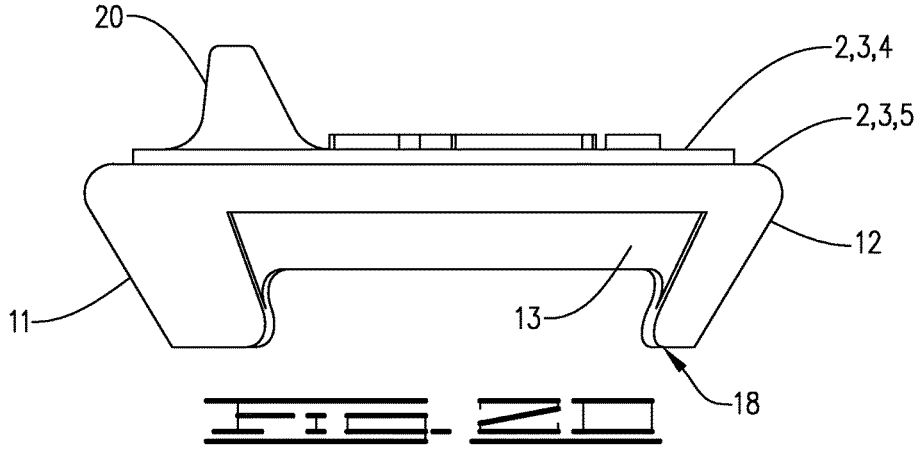
FIG. 2D is a side view of the lid of FIG. 2A.
Figure 2E:
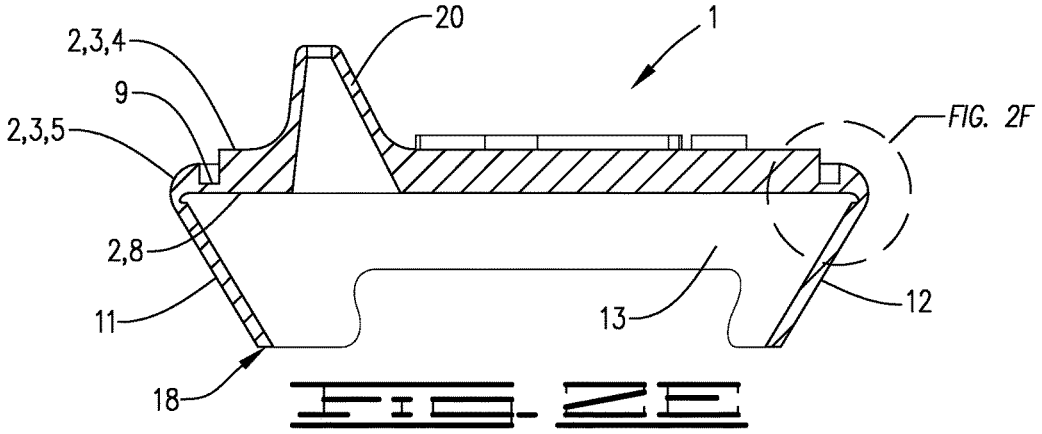
FIG. 2E is a cross-sectional view of the lid of FIG. 2D.
Figure 2F:
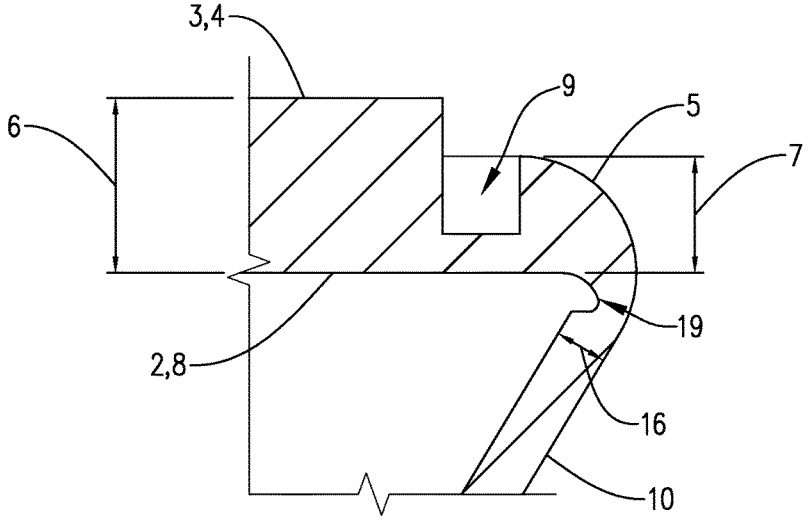
FIG. 2F is an enlarged view of the cross-section of FIG. 2E.
Figure 2G:
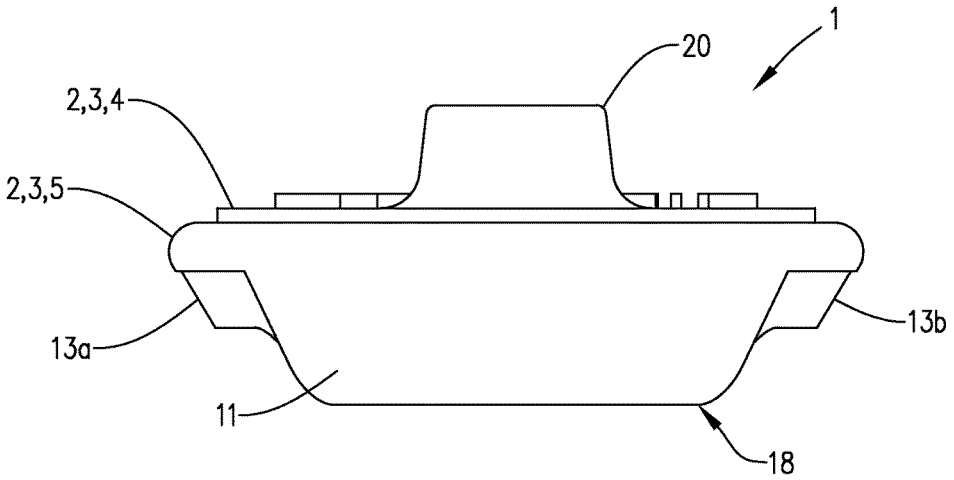
FIG. 2G is another view of the lid of FIG. 2A.
Figure 2H:
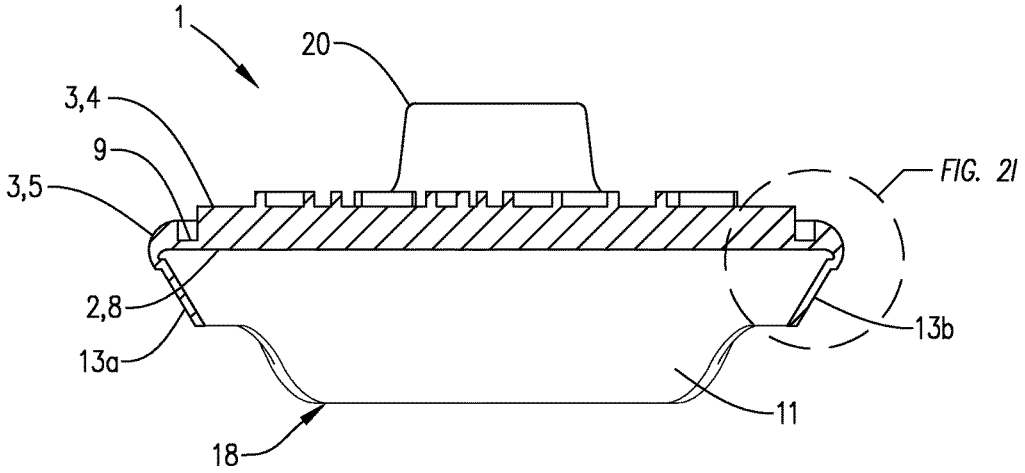
FIG. 2H is a cross-sectional view of the lid of FIG. 2G.
Figure 21:
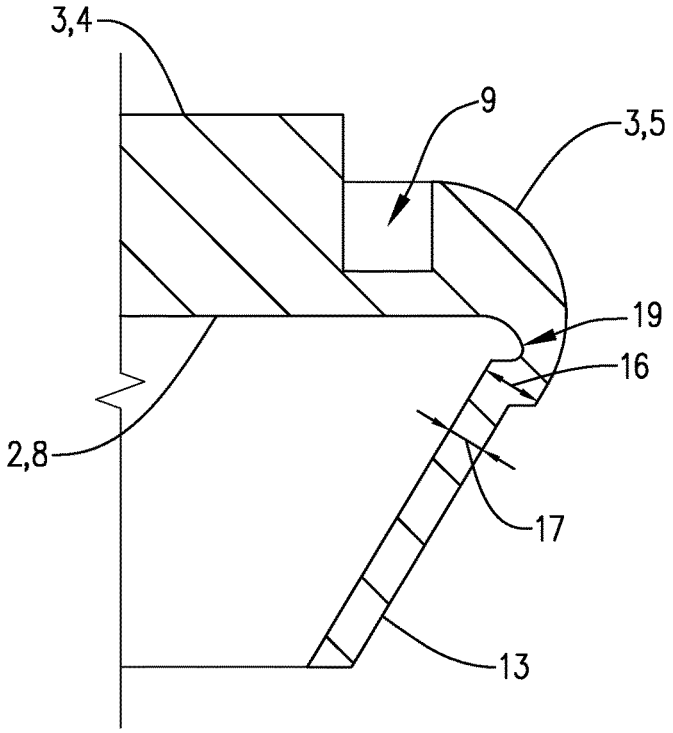
Figure 22:
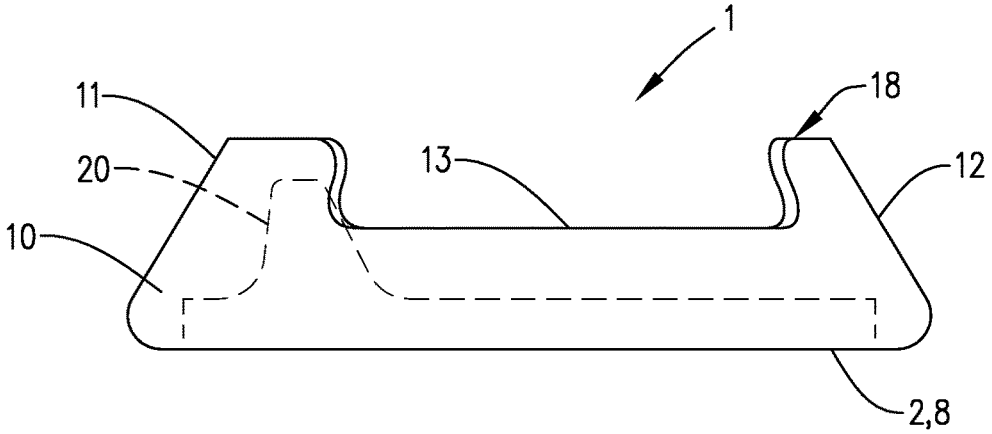
Figure 2K:
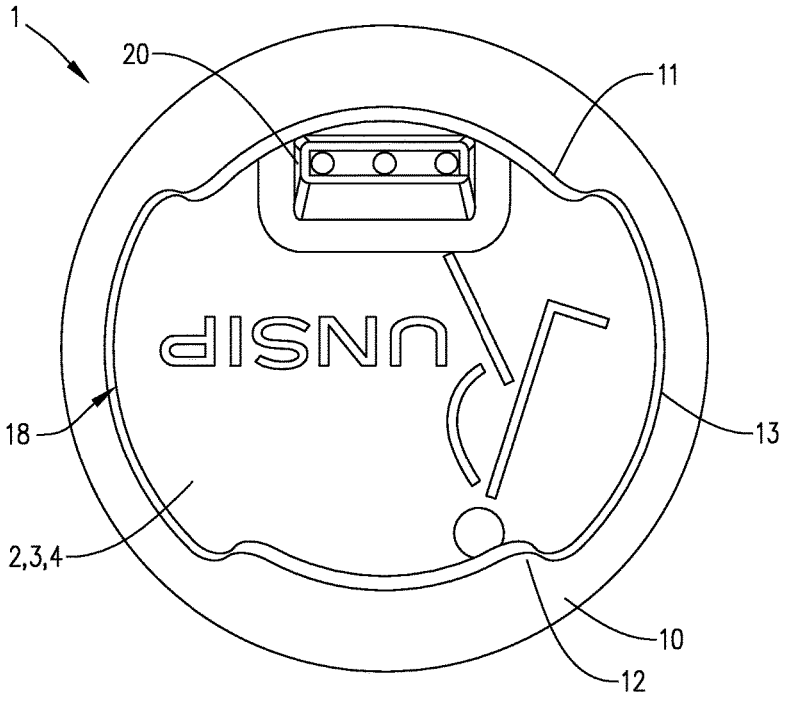
FIG. 2K is a top view of the lid of FIG. 2A in a second position.
Figure 2L:
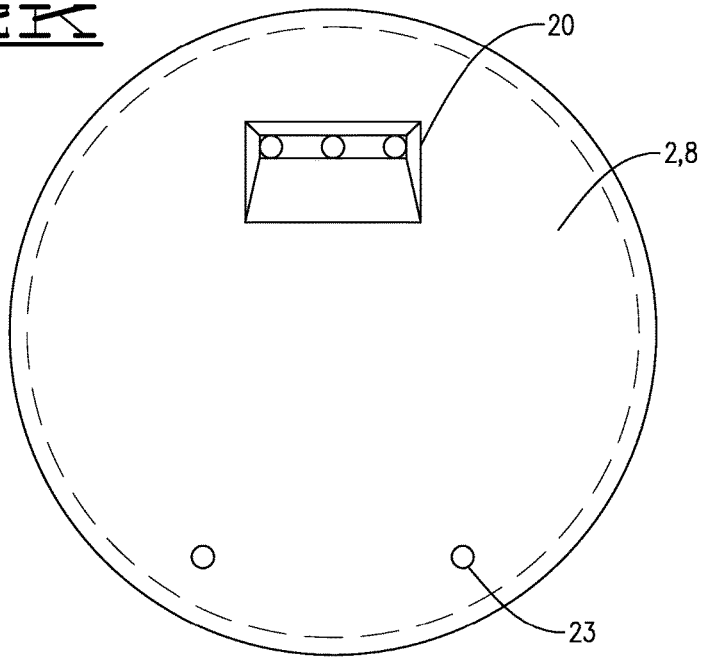
FIG. 2L is a bottom view of the lid of FIG. 2A in a second position.
Figure 3A:
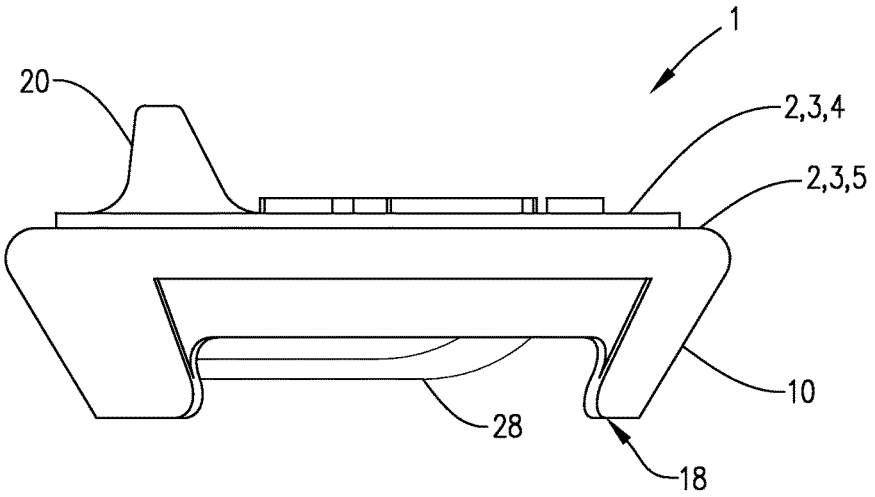
FIGS. 3A-3E depict another example embodiment of the lid.
Figure 3B:
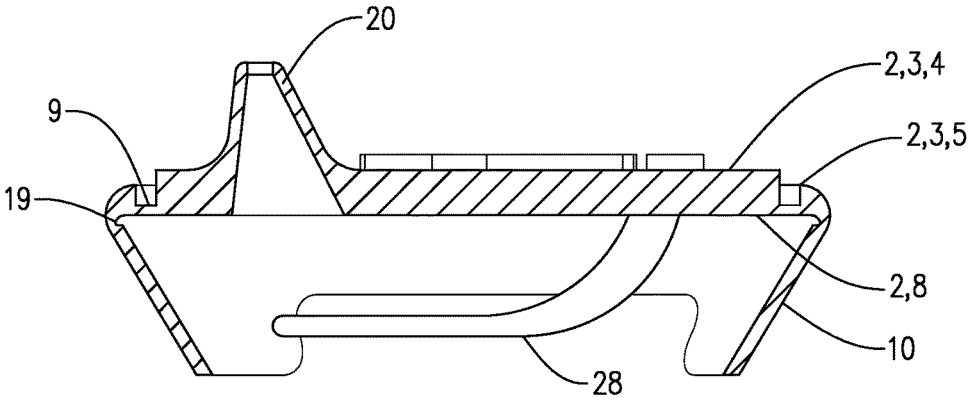
Figure 3C:
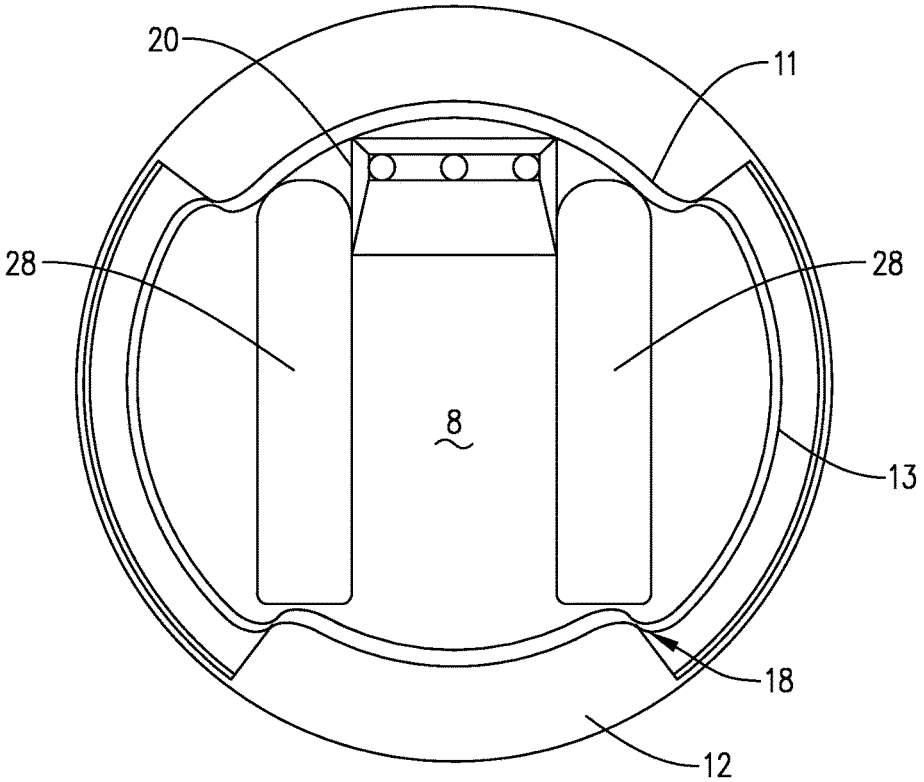
Figure 3D:
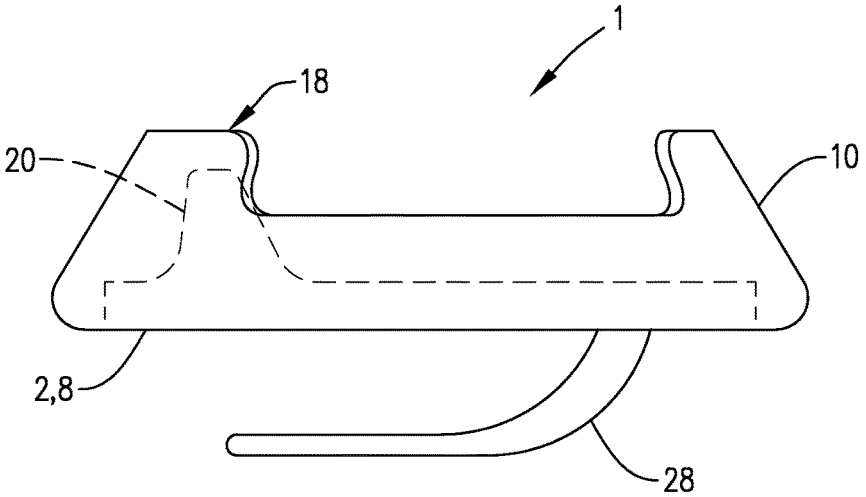
Figure 3E:
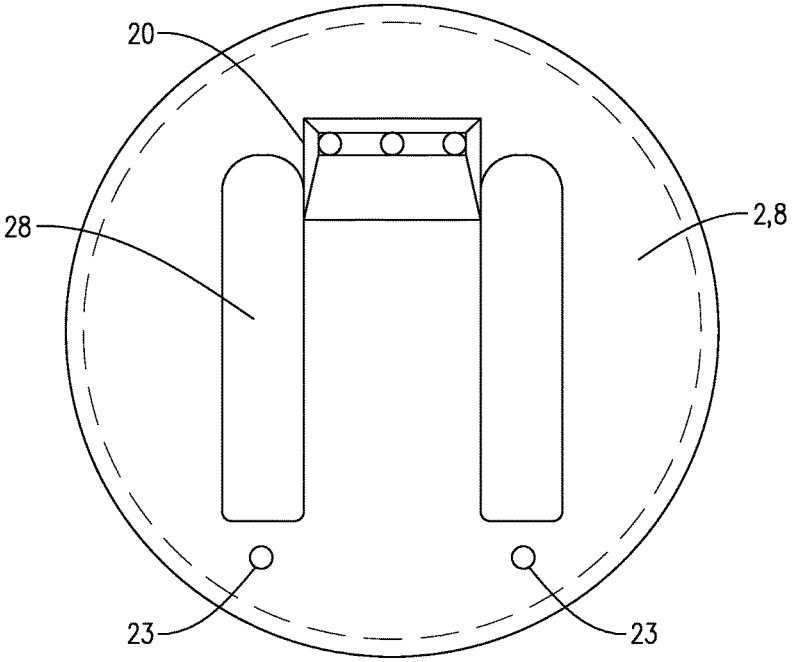

For example, as shown in FIG. 2F, inner portion 4 of top surface 3 has a first thickness 6 and outer portion 5 of top surface 3 has a second thickness 7, the second thickness 7 being smaller than the first thickness 6. In the depicted configuration, the thicker inner portion 4 provides stability for lid 1 when flexible skirt 10 is moved between the first position and the second position by allowing a more stable, e.g. fluid and movement in unison transition of flexible skirt 10 and also contributes to body 2 remaining flat while flexible skirt 10 is in the second position. It should be appreciated that inner portion 4 and outer portion 5 may also have the same thickness.

Body 2 may be any size or shape suitable to cover opening 27 of container 24 and removably secure lid 1 to container 24. Typically, the dimensions of body 2 may range from about 1.25 inches (3.175 centimeters) to about 28 inches (71.12 centimeters) and all values therebetween, in diameter. First thickness 6 of inner portion 4 may range from about 0.04 inches (1.016 millimeters) to about 0.79 inches (2.0 centimeters) and all values therebetween; and second thickness 7 of outer portion 5 may range from about 0.02 inches (0.508 millimeters) to about 0.59 inches (1.498 centimeters) and all values therebetween. Groove 9 should be at least as wide as second thickness 7 such that outer portion 5 can fold into and be received by groove 9 when flexible skirt 10 is moved into the second position.

As shown in the FIGS., lid 1 further includes flexible skirt 10. Flexible skirt 10 is integrally joined to the outer periphery edge of the body 2 and extending therefrom. Flexible skirt 10 includes a front panel 11 and a back panel 12. Front panel 11 and back panel 12 are positioned on opposite sides of the periphery of body 2 from each other. Front panel 11 and back panel 12 may be substantially the same length with each other or may be different.

Flexible skirt 10 also includes two side panels 13*a*, 13*b* between front panel 11 and back panel 12, as shown by the FIGS. In the depicted FIGS., each side panel 13 is shorter than front panel 11 and back panel 12. In such an arrangement, front panel 11 and back panel 12, and each shorter side panel 13 aid the user in the use of a one-handed transition between first position and second position, should a user desire to use a single hand Although not depicted, side panels 13 may also be the same length as front panel 11 and back panel 12.

As shown in FIG. 2C, front panel 11 has a first width 14 and back panel 12 has a second width 15 where second width 15 is smaller than the first width 14. As depicted in FIGS. 4A-4D, front panel 11 having first width 14 comes in contact with two or more of a user's fingers and back panel 12 having second width 15 is engaged by the user's thumb. It should be appreciated that a user may orient and engage the front and back panels in a position comfortable to the user. In other embodiments, first width 14 and second width 15 are equal. Front panel 11 and the back panel 12 each have a third thickness 16. Third thickness 16 may range from about 0.039 inches (0.99 millimeters) to about 0.2 inches (5.08 millimeters), and all values therebetween.

Each side panel 13 each have a transitional thickness where the thickness decreases from the third thickness 16 to a fourth thickness 17 as depicted in FIG. 2I, and thereby allow for a smooth transition between first position and second position during one-handed use. As shown in the FIGS., the fourth thickness 17 is smaller (or thinner) than the third thickness 16. Fourth thickness 17 is approximately half as thick as third thickness 16. As shown in the FIGS. the transitional thickness is on the outside or exterior of flexible skirt 10 as to not interfere with the sealing functionality described herein of lid 1. For differing lid 1 sizes, fourth thickness 17 may range from about 0.02 inches (0.508 millimeters) to about 0.14 inches (3.55 millimeters), and all values therebetween. Although not depicted, side panels 13 may also have the same thickness a front panel 11 and back panel 12.

In other embodiments, depending on the end-use of lid 1 and whether it is desired to secure lid 1 to a container using a single hand, the ability for flexible skirt 10 to effectively flip between first position and second position with one hand without shorter side panels 13*a* and 13*b* not flipping down is dependent on a combination of lengths and widths of the front and back panels, and the side panels. For example, to flip flexible skirt 10 with one hand, it is preferred, though not required, to have back panel 12 narrower than front panel 11, and side panels 13*a* and 13*b* shorter and less thick than the front and back panels.

As shown in FIGS. when flexible skirt 10 is in the first position, flexible skirt 10 projects downward and away from top surface 3 and flexible skirt 10, including front panel 11, back panel 12, and side panels 13*a*, 13*b* are angled such that the edge 18 of flexible skirt 10 distal from the body 2 define a perimeter less than the perimeter of the body 2. Any angle is suitable such that the desired features and functionality described herein is achieved. As shown in FIGS. when flexible skirt 10 is in the second position, flexible skirt 10 projects upward and away from the bottom surface 8. In other words, the second position is inverted from the first position.

Front panel 11 and back panel 12 of flexible skirt 10 each may range in length from about 0.20 inches (5.08 millimeters) to about 5.0 inches (12.7 centimeters), and all values therebetween. The ratio of the length of front panel 11 and back panel 12 of flexible skirt 10 to the diameter of body 2 may range from about 1:3 to about 1:25, and all values therebetween. Side panels 13*a*, 13*b* of flexible skirt 10 each may range in length from about 0.079 inches (2.0 millimeters) to about 3.0 inches (7.62 centimeters), and all values therebetween. The ratio of the length of each side panel 13 to front panel 11 and back panel 12 of flexible skirt 10 may range from about 2:5 to about 1:7, and all values therebetween. It should be appreciated that front and back panels may not always be the same length or thickness along with the above described variance in width.

Movement of flexible skirt 10 between the first position and the second position permits removable coupling between the lid 1 and a container. As shown in FIGS. 4A-4E upon applying lid 1 to container 24, flexible skirt 10 engages and squeezes an exterior surface of container 24 when flexible skirt 10 is in the first position and creates a substantial seal between lid 1 and container 24. In addition, flexible skirt 10 does not engage the interior of container 24 when lid 1 is removably secured thereto.

To removably secure lid 1 to container 24, flexible skirt 10 in the first position extends down the outer surface of container 24 from the top of rim or edge 25 to a distance sufficient to removably couple lid 1 and container 24 together. The distance sufficient to removably couple lid 1 and container 24 together will vary depending on the sizes of lid and container.

With reference to FIGS. 2F and 2I, lid 1 may also include an inner recess 19 along an inner perimeter defined by the union of the periphery of the bottom surface 8 of the body 2 and flexible skirt 10. Inner recess 19 is configured to receive an edge 25 of container 24. Inner recess 19 assists with the substantial seal created between lid 1 and container 24. For example, for configurations of lid 1 including inner recess 19, inner recess 19 opens or flexes slightly to receive edge 25 and thereby create a seal around the exterior edge 25 of container 24.

Due to a wide variety of container sizes and opening sizes of containers, body 2 in combination with flexible skirt 10, may entirely cover the opening 27 or body 2 may cover a majority of opening 27 of container 24. For example, where body 2 only covers a majority of opening 27, flexible skirt 10 provides the remainder of the covering over opening 27 and further extends over container's edge 25 and down the container's exterior surface to provide a releasable seal sufficient to retain the contents of container within container and thereby releasably securing lid 1 to container 24.

Lid 1 may also include a fastening member 28 as shown in FIGS. 3A-3E. Fastening member 28 may be carried by bottom surface 8 of the body. When flexible skirt 10 is in the second position, fastening member 28 provides removable coupling of lid 1 to an item of clothing or other object.

Fastening member 28 is positioned on body 2 to generally avoid contact with and not interfere with or otherwise obstruct flexible skirt 10. For configurations of lid that include fastening member 28, fastening member 28 may be integrally joined with body 2 during the manufacturing process of lid. Additionally, fastening member 28 may be separately bonded or otherwise joined with body 2 after the manufacture of lid. Although depicted as located on the bottom surface of body, fastening member may also be positioned on the top or first surface of body.

For example, in configurations of lid 1 that include fastening member 28, positioning of flexible skirt 10 in the second position will expose fastening member 28 such that flexible skirt 10 does not interfere or otherwise obstruct the ability of fastening member 28 to removably couple lid 1 to an object.

In FIGS. 3A-3E, fastening member 28 is depicted as a clip. The depicted device includes configurations having one or more fastening members. Additionally, the placement of fastening member 28 on body 2 may vary depending on the type of fastening member used, the size of body, and/or the size of fastening member. Any location of fastening member on body is suitable such that fastening member does not interfere with the described features and functions of the other components described herein.

For example, when fastening member 28 is a clip, the clip has sufficient resiliency to permit deflection of clip away from body 2 thereby enabling temporary coupling of lid 1 to an object by placement of the object between clip 28 and body 2. In particular, the degree of resilience should permit sliding of lid along the coupling point. In such an example, fastening member and the object are removably coupled and may generally be held together by friction. In the clip embodiment of fastening member, the connection mechanism and forces experienced are similar to, for example, a paper clip holding papers together, or a bobby pin holding hair, or a vehicular visor clip, such as a garage door opener on a visor. It should be appreciated as the size of lid varies, the size of fastening member may also vary such that the size of fastening member does not obstruct or prohibit the ability of lid to removably attach to a container whilst flexible skirt 10 is in a first position. In addition, fastening member 28 will be of a size suitable to enable removable attachment of lid 1 to an object when flexible skirt 10 is in a second position.

Fastening member 28 may be any fastener suitable for achieving the above-described functions. For example, fastening member 28 may include, for example, snap fasteners, hooks, buttons, magnetic fastening mechanisms, screwing mechanisms, retaining pins, clasps, spring-type clothespin, or combinations thereof. Fastening member 28 may be integrally coupled to bottom surface 8 such that fastening member 28 and bottom surface 8 are flush with one another. It should be appreciated that for whatever fastening mechanism used for fastening member, that object will have the appropriate mating mechanism, if necessary, known in the art to couple with fastener member.

Lid 1 may also include spout 20 extending outward from top surface 3. Spout 20 includes top end 21 and an opening 22 in top end. Spout 20 defines an opening or conduit in body 2 and permits fluid communication through body 2.

Lid 1 may optionally include one or more holes 23 of similar or varying sizes between top surface 3 and bottom surface 8 of the body 2. Hole 23 provides fluid communication through body 2. For example, hole 23 may be large enough to permit a straw to be positioned therein.

In another aspect, hole 23 may serve as an air vent and permit fluid, e.g. air, to pass through body in order to prevent a vacuum effect when lid 1 is removably coupled with a container 24. For example, with reference to FIGS. 2, 3, and 4, lid 1 contains two holes 23 placed at the one o'clock and eleven o'clock positions of body 2 (with spout 20 positioned in at six o'clock) in order to account for the noses of users inadvertently covering or blocking a vent hole placed at the twelve o'clock position. It should be appreciated that the placement of holes 23 can be anywhere on the lid such that the described functionality of hole 23 is achieved.

FIGS. 4A-4E depict a method of removably securing lid to container as well as illustrating the various positions flexible skirt 10 takes as it transitions between the second position and the first position.

Figure 4A:
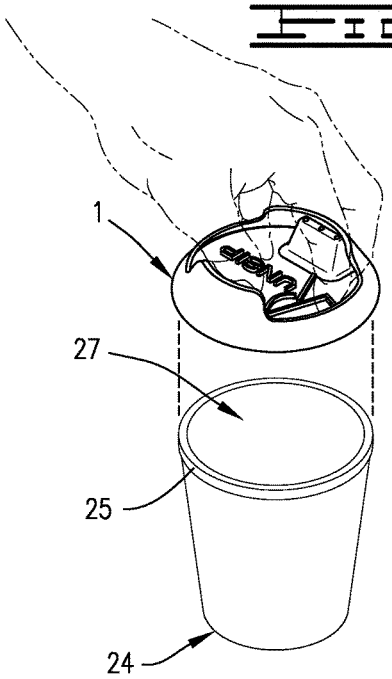
FIGS. 4A-4E are exemplary illustrations of placing the lid on a container.
Figure 4B:
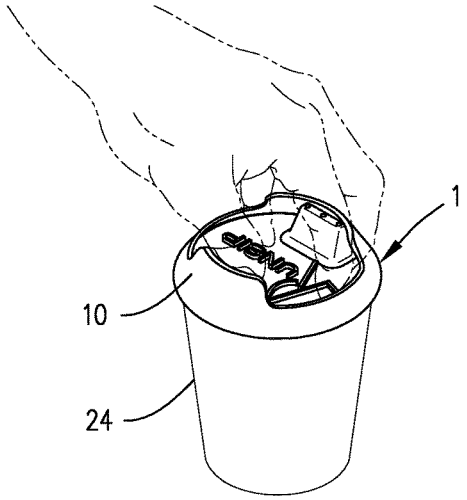

As shown in the FIGS. container 24 includes an open end 27 defined by the edge of the container or rim 25. Container 24 defines a cavity for receiving a fluid or other contents therein. As shown in FIGS. 4A-4E, body 2 is of a size that completely covers open end 27 and is supported by rim 25. As previously described, lid 1 contains an inner recess 19 configured to receive the edge 25 of container 24. The method of removably securing lid 1 to container 24 includes positioning lid 1 with flexible skirt 10 in a second position above the open end 27 of container 24. As shown in FIGS. 4A and 4B, flexible skirt 10 extends upward from top surface 3 when flexible skirt 10 is in the second position. As depicted in FIGS. 4A and 4B, the user may place his/her hand within the area defined by the edge 18 of flexible skirt 10 with his/her fingers in close proximity to each other. When lid 1 is placed on container 24, rim 25 supports lid 1.

The method further includes securing lid 1 and container 24 together by moving flexible skirt 10 from the second position to a first position by causing flexible skirt 10 to flip about the flexible zone defined by groove 9 to cause engagement of flexible skirt 10 with an outer surface of container 24 thereby forming a removable attachment and substantial seal between lid 1 and container 24. As shown in FIG. 4E, flexible skirt 10 extends downward from the top surface of body 2 when flexible skirt 10 is in the first position.

For example, as shown in FIGS. 4A-4E the securing step is accomplished through use of a single hand. While the figures show the container stationary with respect to lid 1, it should be appreciated at container 24 may be held by the user's other hand as lid 1 is removably coupled thereto. It should be appreciated that the coupling of lid 1 and container 24 together can be accomplished by use of more than one hand and/or by more than one individual cooperating together.

Figure 4C:
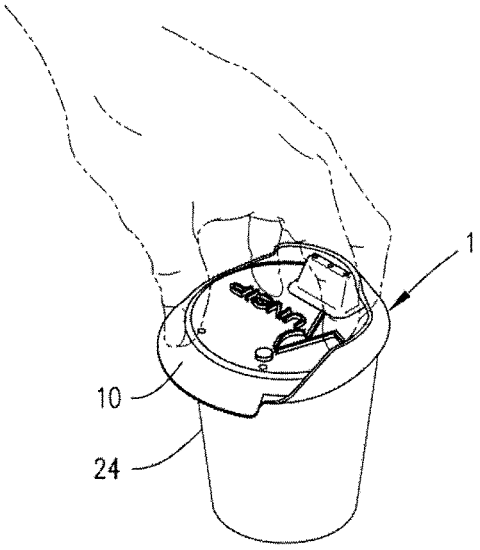
Figure 4D:
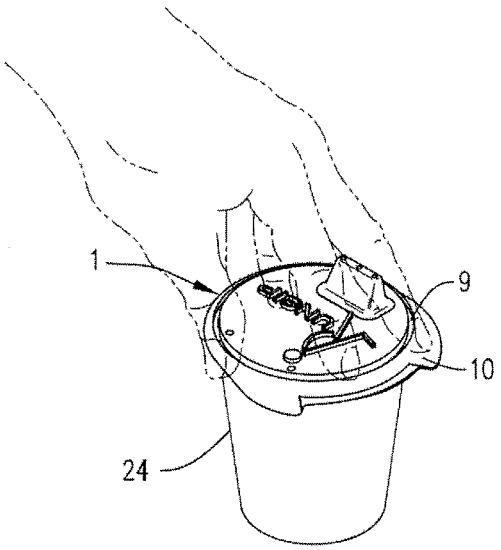
Figure 4E:
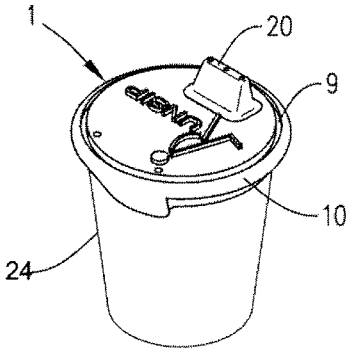

FIGS. 4C and 4D illustrate the user flaring his/her fingers of hand outward from the center of his/her palm to cause flexible skirt 10 to move from the second position to the first position. Any movement of the user's hand, use of more than one hand by one or more individuals, or any mechanism of causing flexible skirt 10 to move from the second position to the first position in order to removably couple lid 1 and container 24 is also suitable. For example, in the depicted embodiment of lid 1, the difference in width of each panel 11, 12 assists with the transitioning between the second and first positions. For example, a user may find it easier and more effective to cause back panel 12 to engage container 24 first before flaring his fingers to cause front panel 11 to engage container 24.

FIG. 4E illustrates the flexible skirt 10 engaged with container 24 when sealing member is in the first position. Flexible skirt 10 does not engage the interior of container 24. As was previously discussed, flexible skirt 10 conforms to and squeezes the exterior surface of container 24 and thereby removably couple lid 1 and container 24. As a result of this coupling, a substantial seal between lid 1 and container 24 is created. The substantial seal prevents liquid within container 24 from spilling out of open end 27. For example, where lid 1 includes spout 20 and/or hole 23, liquid may pass through either opening or both.

After the securing step is complete, the method may further include disengaging of lid 1 from container 24 by causing flexible skirt 10 to partially move away from container 24 so that lid 1 and container 24 may be moved apart from each other. The disengaging step may also be accomplished by moving flexible skirt 10 from the first position to the second position.

In the described embodiments, the selected material comprising the lid will be generally safe for use in connection with human consumption and will not be susceptible to erosion or wear due to contact with the contents to be housed within the container or due to environmental exposure. The material comprising the lid is generally made from a material or materials with characteristics similar to an elastomer, including, but not limited to, a substantially fluid-impermeable elastomeric type materials, i.e. materials, natural or synthetic, that emulate one or more characteristics of rubber, elastomers, rubber-like materials, and elastomeric-like materials. The rubber or elastomeric type materials may be in the form of polymers or copolymers having elastomeric properties or the quality of elasticity. Although not exclusively, such elastomeric materials may be comprised of, include, or be blended with one or more of the following: ethylene-propylene monomer, ethylene-propylene-diene monomer, cis-polyisoprene, cis-polybutadiene, styrene-butadiene rubber, or various plastic polymers including but not limited to polypropylene or polystyrene. Such elastomeric materials may be modified by the covalently linking of multiple elastomers, cross-linking of polymer chains (vulcanization), addition of fillers, or treatment with chemicals.

For example, suitable materials comprising the lid 1 exhibit tensile strengths at break when measured at 73° F. (degrees Fahrenheit) in the range of about 250 psi (pounds per square inch) to about 550 psi; material tensile elongation when measured at 73° F. in the range of about 340% to about 800%; and, Shore A hardness values between about 27 to about 55. For example, suitable materials for lid 1 and all components of the lid may be made of one or more elastomeric type materials selected from the group consisting of elastomers, thermoplastic elastomers (TPE), thermoplastic vulcanizates (TPV), rubber, polypropylene, polychloroprene, silicone, plastic, and combinations thereof. In most applications of the present device, the suitable materials will typically be safe for use in association with human consumption per standards set by appropriate governmental authorities.

The hardness of the materials comprising lid 1 may be adjusted during the manufacturing process depending upon end-use applications. For example, the lid depicted herein may be made of a single material, including the fastening members, and all integrally formed and all components having the same Shore hardness value, for example Shore A hardness. For example, all portions of the lid may be made of a thermoplastic elastomer material called Versaflex™ 2242 with a hardness of 42 Shore hardness provided by PolyOne Corporation, headquartered at 33587 Walker Road, Avon Lake, Ohio, USA 44012.

All components of lid 1 may be made of a material suitable to be used in association with human consumption and to withstand varying temperatures, e.g. hot or cold, of the contents within container as well as from the environment in which lid is positioned. It should be appreciated that all components of lid may be made of the same or different materials and formulations.

The hardness of the materials comprising lid 1 may be adjusted during the manufacturing process depending upon end-use applications of lid 1. For example, when front panel 11 and back panel 12 of flexible skirt 10 are each approximately 15.0 millimeters (mm) in length and body 2 is approximately 74 millimeters in diameter (a ratio of about 1:4.93), the hardness of body 2 may be approximately 70±40 Durometer of Shore Type A and the hardness of sealing member 14 may be approximately 40±15 Durometer of Shore Type A. As the diameter of body 2 and the length of front panel 11 and back panel 12 increase, the hardness of the materials may also increase to an extent depending on the end use of lid 10. Similarly, as the diameter of body 2 and the length of front panel 11 and back panel 12, the hardness may decrease to an extent depending on the end use of lid 1. For example, if the end use of lid 1 will be for covering containers that can be stacked, the body 2 may need to be harder than flexible skirt 10.

As shown in the embodiments illustrative by the FIGS., lid 1 is depicted as generally circular in shape. It should be appreciated that lid 1 may take the form of various geometric shapes, for example, a square, rectangle, triangle, pentagon, ellipse, etc. The shape of lid 1 can be the same shape of the opening of the container or can be a different shape than the opening of the container.

The present disclosure is not limited to the above examples and descriptions. Other embodiments will be apparent to one skilled in the art. As such, the foregoing description merely enables and describes the general uses and methods disclosed herein. While certain embodiments have been described for the purpose of this disclosure, those skilled in the art can make changes without departing from the spirit and scope thereof. The scope is to be determined by reference to the appended claims.

What is claimed is:

1. A lid comprising:

a body having a top surface and a planar bottom surface opposite said top surface, and a groove in said top surface, said top surface including a generally planar inner portion and an outer portion concentric with and surrounding said generally planar inner portion, wherein a surface of the outer portion distal from said generally planar inner portion defines an outer periphery edge of the body, and said groove in said top surface separates the top surface generally planar inner portion and the top surface outer portion, wherein said groove is concentric with and surrounding said generally planar inner portion and said groove is concentric with and surrounded by said outer portion, and wherein said planar bottom surface of said body underlies each of said generally planar inner portion, said groove, and said outer portion of said top surface; and a flexible skirt integrally joined to the outer periphery edge of the body and extending therefrom and said flexible skirt and said body are a single piece, wherein the groove defines a flexible zone which permits the flexible skirt to flip between a first position and a second position, and when said flexible skirt is in said first position said groove has a first width and when said flexible skirt is in said second position said groove has a second width, said second width of said groove is narrower than said first width of said groove, and when said flexible skirt is in said second position a portion of said outer portion of said top surface is received in said groove, wherein when the flexible skirt is in the first position the flexible skirt projects downward and away from the top surface and an edge of the flexible skirt distal from the body defines a perimeter less than the perimeter defined by the outer periphery edge of the body, and wherein the second position is inverted from the first position.

2. The lid of claim 1, wherein the generally planar inner portion of the top surface of the body has a first thickness as defined between said top surface and said bottom surface, and the outer portion of the top surface of the body has a second thickness as defined between said top surface and said bottom surface and the second thickness is smaller than the first thickness.

3. The lid of claim 1, wherein the outer periphery edge of the body is a rounded surface.

4. The lid of claim 1, wherein the flexible skirt includes a front panel and a back panel, wherein the front panel and the back panel are positioned on opposite sides of the outer periphery of the body from each other, and wherein the flexible skirt includes two side panels between the front and back panels, and wherein each side panel is shorter than each of the front and back panels.

5. The lid of claim 4, wherein the front panel has a first width and the back panel has a second width and the second width is smaller than the first width.

6. The lid of claim 4, wherein the front panel and the back panel each have a same thickness and each side panel each have a transitional thickness where the thickness of each side panel decreases from the thickness of said front and back panels to a smaller thickness.

7. The lid of claim 4, wherein a ratio of the length of either of the front panel and back panel of the flexible skirt to the diameter of the body ranges from about 1:3 to about 1:25.

8. The lid of claim 1, wherein movement of the flexible skirt between the first position and the second position permits removable coupling between the lid and a container.

9. The lid of claim 1, wherein upon applying the lid to a container with the flexible skirt in the second position, said flexible skirt is configured to flip to said first position and engage and squeeze an exterior surface of the container thereby removably coupling the lid and the container together and create a substantial seal between the lid and the container.

10. The lid of claim 1, further comprising:

an inner recess along an inner perimeter defined by the union of the periphery of the bottom surface of the body and the flexible skirt, the inner recess configured to receive an edge of a container.

11. The lid of claim 1, further comprising:

a spout extending upward from said generally planar inner portion of the top surface, wherein the spout includes a top end and an opening in the top end, and wherein the spout defines an opening in the body to provide fluid communication through the body.

12. The lid of claim 11, further comprising:

a hole providing fluid communication through said body.

13. The lid of claim 1, further comprising:

a fastening member carried by the bottom surface.

14. The lid of claim 13, wherein the fastening member is a clip.

15. The lid claim 1, wherein the lid is made of one or more materials selected from the group consisting of elastomers, thermoplastic elastomers, thermoplastic vulcanizates, rubber, polypropylene, polychloroprene, silicone, plastic, and combinations thereof.

16. The lid of claim 1, wherein the lid is made of one or more material that exhibit a tensile strength at break of about 250 pounds per square inch to about 550 pounds per square inch when measured at 73 degrees Fahrenheit, a material tensile elongation in the range of about 340% to about 800% when measured 73 degrees Fahrenheit, and a Shore A hardness value between about 27 to about 55.

17. A lid comprising:

a body having a top surface and a planar bottom surface opposite said top surface, and a groove in said top surface, said top surface including a generally planar inner portion and an outer portion concentric with and surrounding said generally planar inner portion, wherein a surface of the outer portion distal from said generally planar inner portion defines an outer periphery edge of the body, and said groove in said top surface separates the top surface generally planar inner portion and the top surface outer portion, wherein said groove is concentric with and surrounding said generally planar inner portion and said groove is concentric with and surrounded by said outer portion, and wherein said planar bottom surface of said body underlies each of said generally planar inner portion, said groove, and said outer portion of said top surface; and a flexible skirt integrally joined to the outer periphery edge of the body and extending therefrom and said flexible skirt and said body are a single piece, wherein the flexible skirt includes a front panel and a back panel, the front panel and the back panel are positioned on opposite sides of the outer periphery of the body from each other, and two side panels between the front and back panels, each side panel being shorter than each of the front and back panels; and an inner recess along an inner perimeter defined by the union of the periphery of the bottom surface of the body and the flexible skirt, the inner recess configured to receive an edge of a container, wherein the groove defines a flexible zone which permits the flexible skirt to flip between a first position and a second position, and when said flexible skirt is in said first position said groove has a first width and when said flexible skirt is in said second position said groove has a second width, said second width is narrower than said first width, wherein when the flexible skirt is in the first position the flexible skirt projects downward and away from the top surface and an edge of the flexible skirt distal from the body defines a perimeter less than the perimeter defined by the outer periphery edge of the body, and wherein the second position is inverted from the first position.

18. The lid of claim 17, wherein the generally planar inner portion of the top surface of the body has a first thickness as defined between said top surface and said bottom surface, and the outer portion of the top surface of the body has a second thickness as defined between said top surface and said bottom surface and the second thickness is smaller than the first thickness.

19. The lid of claim 17, wherein the front panel has a first width and the back panel has a second width, and wherein the second width is smaller than the first width.

20. The lid of claim 17, wherein the front panel and the back panel each have a same thickness and each side panel each have a transitional thickness where the thickness of each side panel decreases from the thickness of said front and back panels to a smaller thickness.

21. The lid of claim 17, wherein upon applying the lid to a container with the flexible skirt in the second position, said flexible skirt is configured to flip to said first position and engage and squeeze an exterior surface of the container thereby removably coupling the lid and the container together and create a substantial seal between the lid and the container.

22. The lid of claim 17, further comprising:

a spout extending upward from the top surface, wherein the spout includes a top end and an opening in the top end, and wherein the spout defines an opening in the body to provide fluid communication through the body.

23. The lid of claim 17, further comprising:

a fastening member carried by the bottom surface.

24. A method of removably securing a lid to a container, the container including an open end, and the lid including a body having a top surface and a planar bottom surface opposite said top surface, and a groove in said top surface, said top surface including a generally planar inner portion and an outer portion concentric with and surrounding said generally planar inner portion, wherein a surface of the outer portion distal from said generally planar inner portion defines an outer periphery edge of the body, and said groove in said top surface separates the top surface generally planar inner portion and the top surface outer portion, wherein said groove is concentric with and surrounding said generally planar inner portion and said groove is concentric with and surrounded by said outer portion, and said bottom surface of said body underlies each of said generally planar inner portion, said groove, and said outer portion of said top surface, said lid further includes a flexible skirt integrally joined to the outer periphery edge of the body and extending therefrom and said flexible skirt and said body are a single piece, wherein the groove defines a flexible zone which permits the flexible skirt to flip between a first position and a second position and when said flexible skirt is in said first position said groove has a first width and when said flexible skirt is in said second position said groove has a second width, said second width of said groove is narrower than said first width of said groove, the method comprising:

positioning the lid, with the flexible skirt in the second position, over the open end of the container, wherein the flexible skirt extends in an upward direction from the top surface when the flexible skirt is in the second position;

securing the lid and the container together by moving the flexible skirt from the second position to the first position by causing the flexible skirt to flip about the flexible zone to cause engagement of the flexible skirt with an outer surface of the container thereby forming a removable attachment and a substantial seal between the lid and the container, wherein the flexible skirt extends in a downward direction from the top surface of the body when the flexible skirt is in the first position.

25. The method of claim 24, wherein the lid further includes a spout extending outward from the top surface, wherein the spout includes a top end and an opening in the top end, and wherein the spout defines a conduit to permit fluid communication through the body.

26. The method of claim 24, further comprising the step of:

disengaging the lid from the container by causing the flexible skirt to move away from the container, wherein the disengaging step is done after the securing step.

27. The method of claim 26, wherein the disengaging step causes the flexible skirt to move from the first position to the second position.

28. The method of claim 24, wherein when securing the lid and the container together the flexible skirt does not engage the interior of the container.

* * * * *